US009340966B1

(12) United States Patent
Al-Failakawi

(10) Patent No.: US 9,340,966 B1
(45) **Date of Patent: *May 17, 2016**

(54) METAL REINFORCED CONCRETE BEAM AND METAL REINFORCED BUILDINGS INCORPORATING SUCH BEAMS

(71) Applicant: Naji M. A. M. Al-Failakawi, Kuwait (KW)

(72) Inventor: Naji M. A. M. Al-Failakawi, Kuwait (KW)

( * ) Notice: Subject to any disclaimer, the term of this patent is extended or adjusted under 35 U.S.C. 154(b) by 0 days.

This patent is subject to a terminal disclaimer.

(21) Appl. No.: 14/733,064

(22) Filed: Jun. 8, 2015

Related U.S. Application Data

(62) Division of application No. 14/663,665, filed on Mar. 20, 2015, now Pat. No. 9,074,369.

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 1/20*** | (2006.01) |
| ***E04C 2/06*** | (2006.01) |
| ***E04B 1/30*** | (2006.01) |
| *E04B 1/24* | (2006.01) |
| *E04G 21/26* | (2006.01) |
| *E04B 2/64* | (2006.01) |
| *E04B 1/04* | (2006.01) |

(52) U.S. Cl.
CPC ... *E04B 1/20* (2013.01); *E04B 1/30* (2013.01); *E04C 2/06* (2013.01); *E04B 1/04* (2013.01); *E04B 1/2403* (2013.01); *E04B 2/64* (2013.01); *E04B 2103/02* (2013.01); *E04B 2103/06* (2013.01); *E04G 21/26* (2013.01)

(58) Field of Classification Search
CPC ..... E04B 1/04; E04B 1/2403; E04B 2/64; E04G 21/26; E04C 2/06
USPC ..... 52/236.6, 242, 243, 250, 251, 252, 52/745.03, 745.12, 837, 838, 848, 79.14, 52/79.8, 79.11, 79.12, 831
See application file for complete search history.

(56) References Cited

U.S. PATENT DOCUMENTS

| | | | | |
|---|---|---|---|---|
| 3,093,932 | A * | 6/1963 | Dreier | E04B 5/29 249/25 |
| 3,484,882 | A | 12/1969 | Blanchette | |
| 4,876,759 | A | 10/1989 | Yang | |
| 5,081,805 | A | 1/1992 | Jazzar | |
| 5,444,957 | A | 8/1995 | Roberts | |
| 5,509,243 | A | 4/1996 | Bettigole et al. | |
| 5,755,486 | A * | 5/1998 | Wycech | B29C 70/66 296/187.02 |
| 6,266,938 | B1 | 7/2001 | Sheu et al. | |
| 6,298,630 | B1 | 10/2001 | VeRost et al. | |
| 6,341,467 | B1 | 1/2002 | Wycech | |
| 6,578,343 | B1 | 6/2003 | Dumler et al. | |

(Continued)

*Primary Examiner* — Chi Q Nguyen
(74) *Attorney, Agent, or Firm* — Hauptman Ham, LLP

(57) ABSTRACT

The present invention contemplates a reinforced concrete beam comprising a longitudinally extending concrete beam including a plurality of I-beam receptacles spaced apart along the length thereof and wherein each of the I-beam receptacles has a depth and a width to accommodate an end of an I-beam having an upper and lower metal flange of about equal width and a central metal web connecting the flanges, and in the building a hard rubberlike elastomer spacer is disposed between the I-beam receptacles and an end of an I-beam. The beams further include one to three longitudinally extending metal rods disposed underneath the I-beam receptacles and surrounded by concrete.

4 Claims, 6 Drawing Sheets

(56) References Cited

U.S. PATENT DOCUMENTS

| | | | | |
|---|---|---|---|---|
| 6,863,957 | B2 * | 3/2005 | Wycech | B29C 70/66 239/109 |
| 7,028,435 | B2 | 4/2006 | Walker et al. | |
| 7,373,760 | B2 | 5/2008 | Tokuno et al. | |
| 7,647,742 | B2 | 1/2010 | Han | |
| 8,176,696 | B2 | 5/2012 | LeBlang | |
| 8,671,637 | B2 | 3/2014 | LeBlang | |
| 8,720,154 | B1 | 5/2014 | Home | |
| 8,910,439 | B2 | 12/2014 | Ingjaldsdottir et al. | |
| 9,074,369 | B1 * | 7/2015 | Al-Failakawi | E04B 5/16 |
| 2001/0003234 | A1 | 6/2001 | Van Doren | |
| 2004/0200172 | A1 | 10/2004 | Beck et al. | |
| 2009/0188208 | A1 | 7/2009 | Studebaker et al. | |

* cited by examiner

METAL REINFORCED CONCRETE BEAM AND METAL REINFORCED BUILDINGS INCORPORATING SUCH BEAMS

CROSS REFERENCE TO RELATED APPLICATIONS

The present application is a Divisional of U.S. patent application Ser. No. 14/663,665, filed Mar. 20, 2015, the disclosure of which is herein incorporated by reference in its entirety.

FIELD OF THE INVENTION

This invention relates to metal reinforced concrete beams and metal reinforced concrete buildings incorporating such beams and more particularly to a longitudinally extending metal reinforced concrete beam that includes a plurality of I-beam receptacles each of which has a depth and a width to accommodate an I-beam therein.

BACKGROUND FOR THE INVENTION

Metal reinforced concrete buildings are well known and have been in widespread use for many years. Such buildings have been constructed in many shapes and for many applications.

Examples of such structures are disclosed in the U.S. patent art. For example, a U.S. Pat. No. 3,484,882 of Blanchette discloses a structural bearing Pad assembly for accommodating expansion and contraction as well as oscillatory movement of a structural beam relative to a supporting base or column. A pad of low friction material such as a filled polytetrafluoroethylene is secured to one base plate of steel or the like, and a composite pad of low friction material bonded to a resilient, load resistant material is bonded to another base plate. Each base plate is secured to one of the structural members as by welding in the case of a steel member or embedding in a concrete member.

An additional U.S. Pat. No. 4,876,759 of Yang is directed to a bridge expansion joint for buried inner placement over an expansion seam under a bridge roadway including padding sheets fixed to the bridge deck on either side of the expansion seam in the deck. Padding slats are fixed to the bridge deck outboard of the padding sheets. A steel plate is superimposed above the padding sheets and padding slats and is provided on its underside with sliding pads and padding slats corresponding to the padding sheets and padding slats on the bridge deck. Rivets are anchored in the deck and accommodated in expansion slots in the sliding pads and steel plate. The rivets and slots are covered by guard covers. The joint is intended to be paved over.

Finally, a U.S. Pat. No. 7,373,760 of Tokuno et al. discloses a floor structure comprising a plurality of steel beams arranged in parallel, each steel beam including a web, an upper flange disposed at an upper end of the web, and a lower flange disposed at a lower end of the web, a floor surface being formed on the upper flange. The floor structure further includes a displacement preventing spacer interposed between the upper flanges and/or lower flanges of the adjacent steel beams. The displacement preventing spacer includes a load receiving part which is brought into engagement with the adjacent upper flanges and/or lower flanges to receive an active load incurred by the individual steel beams so as to inhibit the steel beams from displacing downward.

Notwithstanding the above, it is presently believed that there is a need and a potential commercial market for an improved metal reinforced concrete beam and a metal reinforced concrete building incorporating such beams in accordance with the present invention.

SUMMARY OF THE INVENTION

In a first embodiment of the invention, a metal reinforced concrete beam positions and supports a plurality of I-beams that span an open area in a building, the building comprises or consists of the following.

A longitudinally extending metal reinforced concrete beam includes a plurality of I-beam receptacles spaced apart along the length of the beam and wherein each of the I-beam receptacles has a width and a depth to accommodate an I-beam. Each of the I-beams has an upper and a lower metal flange of about equal width and a central metal web connecting the flanges. In addition, a hard rubber like elastomer or hard rubber of about ½ to 1 inch in thickness is disposed on each side and the bottom of each I-beam receptacle between each receptacle and an I-beam disposed therein. Further, the I-beam receptacles are spaced apart by a distance between about the width of an upper or lower flange and three times the width of an upper or lower flange and a length of between about 8 feet and 30 feet.

In a preferred embodiment of the invention, a plurality of I-beams are positioned and supported on each side or end thereof by an I-beam receptacle in a metal reinforced concrete beam on opposite sides of an open span in a building.

In a further embodiment of the invention, a metal reinforced concrete building includes a concrete foundation and a plurality of upwardly extending concrete columns as well as a plurality of concrete walls or walls made of concrete blocks are disposed between the columns. In a preferred form of this embodiment of the invention, a plurality of pairs of beams in accordance with the first embodiment of the invention are disposed on opposite sides of an open area and a plurality of I-beams are positioned and supported by the I-beam receptacles on opposite sides of the open area. As in the first embodiment of the invention, each of the I-beam receptacles have a width and a depth to accommodate an I-beam for positioning and supporting the I-beam along the length of the pair of oppositely disposed metal reinforced concrete beams. As in the earlier embodiment, a plurality of I-beams are spaced apart upon the length of the metal reinforced concrete beam by a distance of between the width of an upper flange and three times the width of the upper flange.

In a third and a fourth embodiment of the invention, the building is a single story building while the fourth embodiment is a multi-story building of preferably two or more stories. In the third and fourth embodiment of the invention, the top story that is at the top of the first story in the third embodiment of the top of the second or higher story of the fourth embodiment, a pair of metal reinforced concrete beams are disposed with one of said metal reinforced concrete beams on top of the uppermost wall on opposite sides of an open area.

The invention will now be described in connection with the accompanying drawings wherein like reference numerals have been used to indicate like parts.

DESCRIPTION OF THE PREFERRED EMBODIMENTS OF THE INVENTION

Figure 1C:
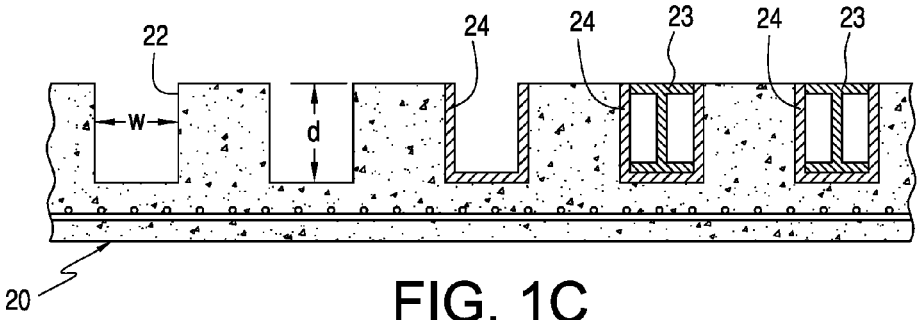
Figure 1D:
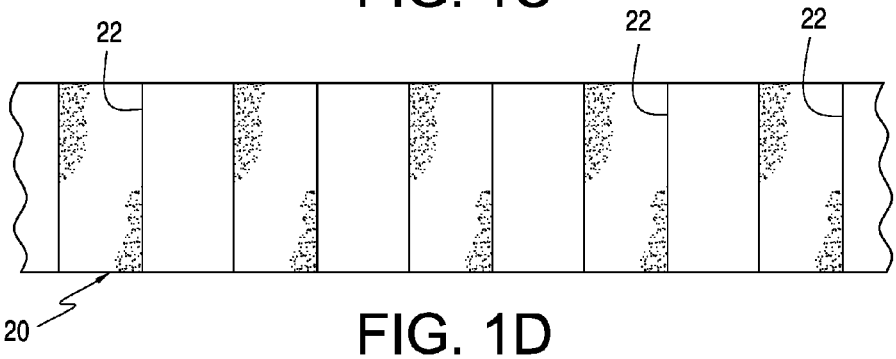

As shown in FIGS. 1*a-d*, a metal reinforced concrete beam 20 includes a plurality of I-beam receptacles 22 that extend across the metal reinforced concrete beam 20. Each of the I-beam receptacles 22 has a width and depth to accommodate an I-beam 23. As illustrated, the I-beam receptacles 22 each include a U-shaped spacer or insulator 24 of a hard rubber like elastomer having a thickness of between about ½ inch and 1 inch as shown more clearly in FIG. 2. While the insulator 24 as shown in FIG. 1*c* has a U-shape, it may be made up of three separate spacers or insulators with one insulator 24 on the bottom of the U and two separate insulators on opposite sides of a receptacle 22.

Figure 3:
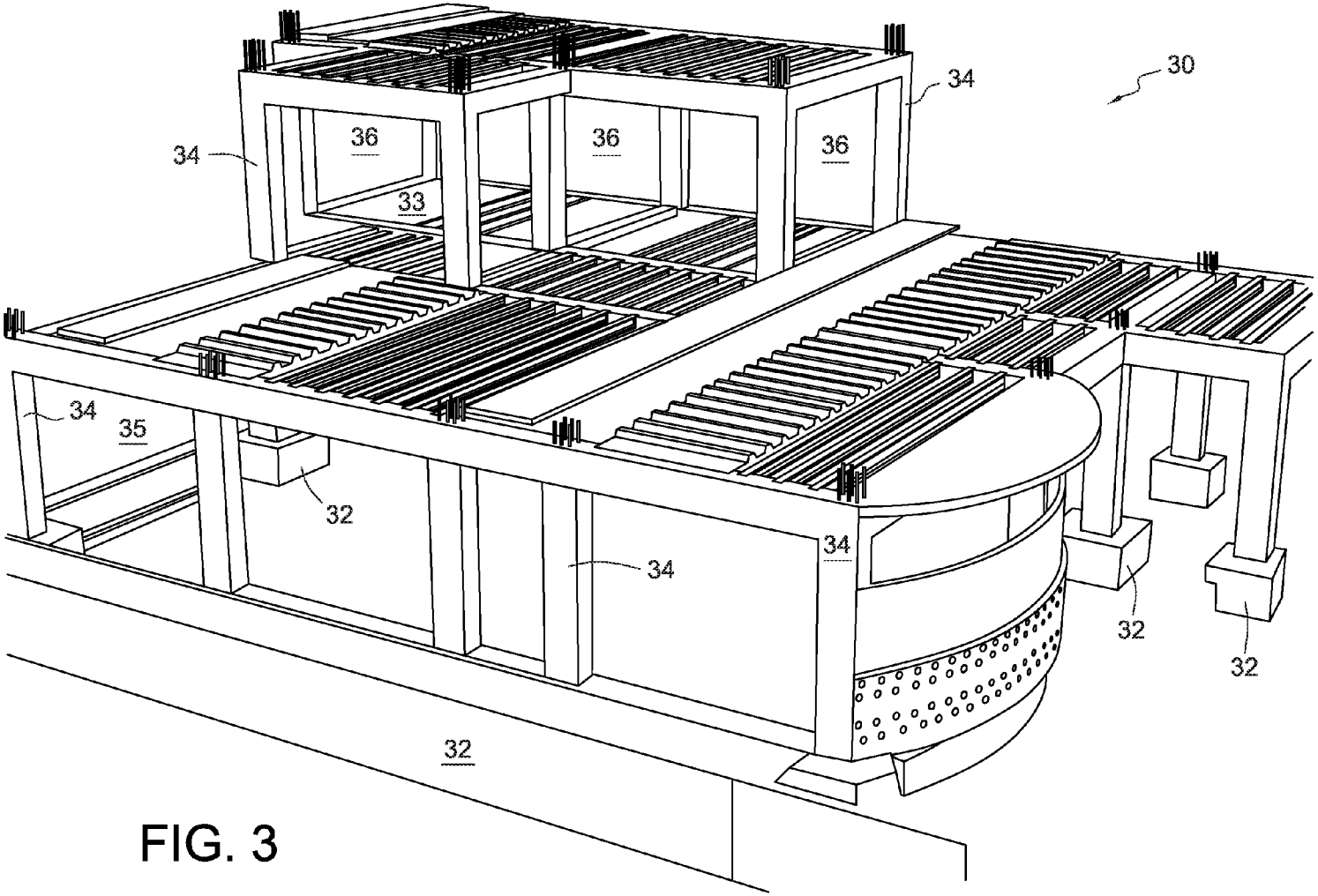
FIG. 3 is a perspective view of a two story building in accordance with the invention.
Figure 5:
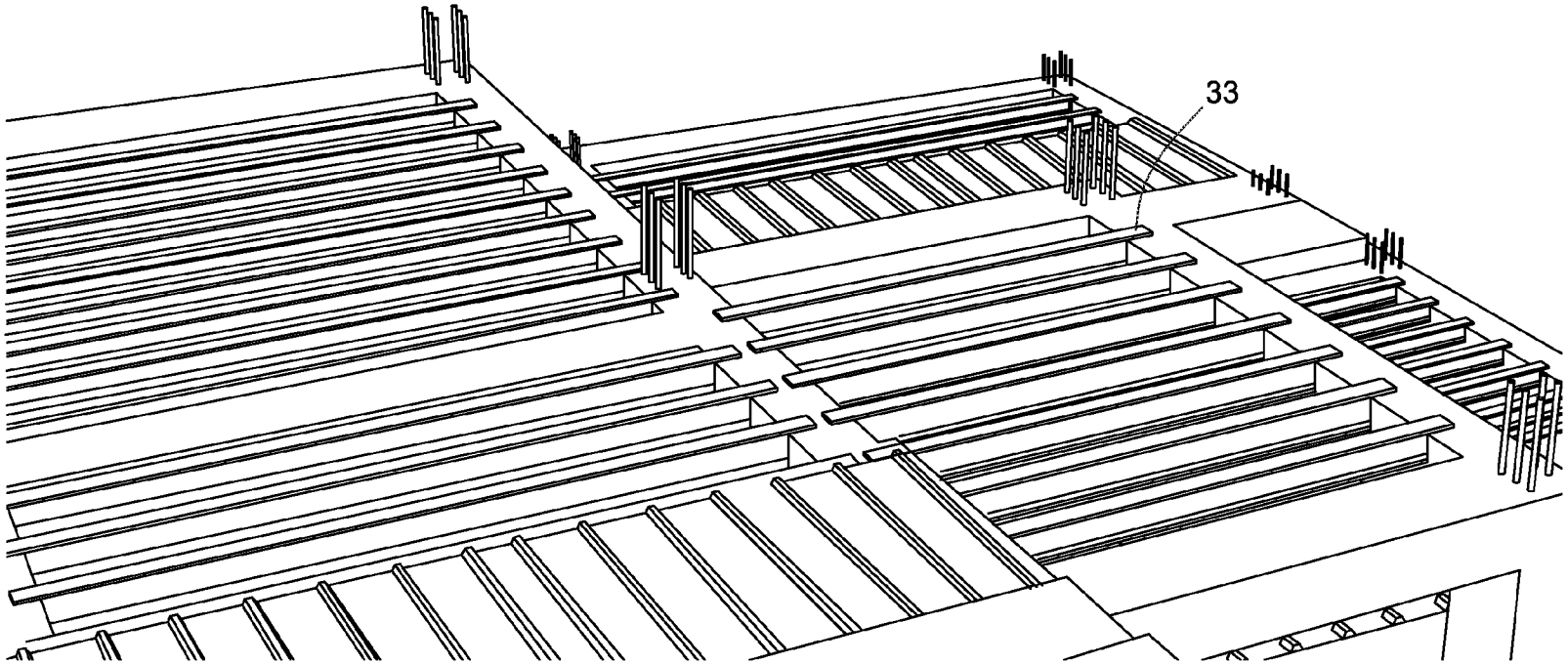
FIG. 5 is an enlarged portion of a building illustrated in FIG. 4.
Figure 6:
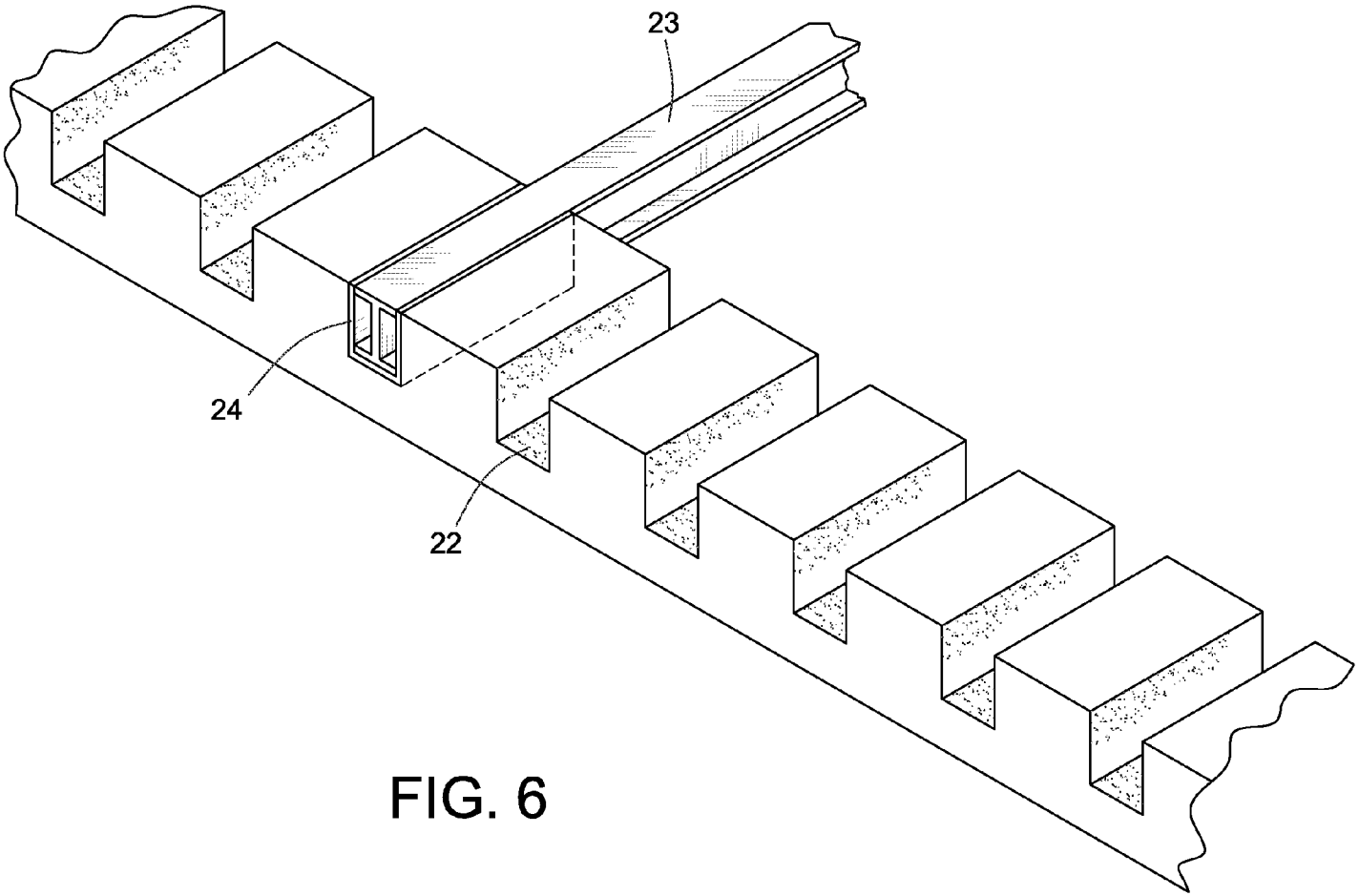
FIG. 6 is a perspective view of a portion of a building illustrated in FIGS. 4 and 5.

In a first preferred embodiment of the invention, a metal reinforced concrete building 30 (FIG. 3) includes a concrete foundation 32, a concrete slab or floor 33 (FIG. 5) and a plurality of upwardly extending columns 34 with one of the columns 34 at each corner of the building 30. In addition, a plurality of concrete walls 36 (FIG. 3) or walls made of concrete blocks connect the columns 34 to surround the building 30. As illustrated, two oppositely disposed walls 36 are disposed on opposite sides of the building 30 or on opposite sides of an open space. The oppositely disposed walls 36 each include a metal reinforced concrete beam 20 that includes a plurality of I-beam receptacles 22 having a width and a depth to accommodate an end of an I-beam 23.

Figure 1A:
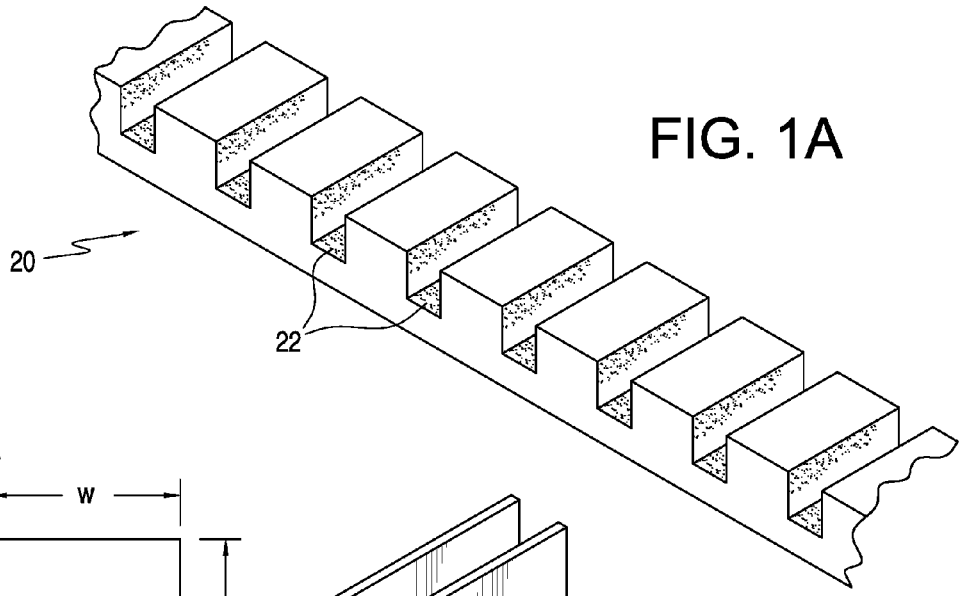
FIGS. 1*a*, 1*b*, 1*c* and 1*d* are views of a metal reinforced concrete beam having a plurality of I-beam receptacles disposed along the length of said beam and wherein each of the I-beam receptacles has a width and a depth to accommodate an I-beam and in which the I-beam receptacles are spaced apart by between about the width of an I-beam flange and three times the width of an I-beam flange and a length of about 8 feet to 30 feet or longer.
Figure 1B:
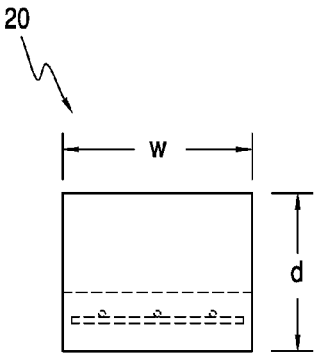
Figure 2:
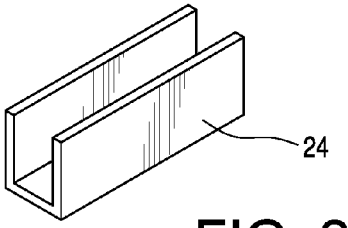
FIG. 2 is a perspective view of a spacer or insulator of hard rubber or elastomer that fits between an I-beam and an I-beam receptacle in a preferred embodiment of the invention.

As illustrated, the I-beam receptacles 22 each include a U-shaped spacer or insulator 24 of a hard rubberlike elastomer having a thickness of between about ½ inch and 1 inch as shown more clearly in FIG. 2. While the insulator 24 as shown in FIG. 1*c* has a U-shape it may be made of three separate spacers or insulators 24 with one disposed on the bottom of the U-shaped receptacle 22 and two separate insulators 24 with one on each side of the receptacle 22. The opposite wall 36 is spaced apart by slightly less than the length of the I-beam 23 so that the opposite ends of the I-beam 23 fit into the opposite I-beam receptacles 22 as spaced by spacers 24 on opposite sides of an open area in the building 30.

A plurality of I-beams 23 parallel to one another extend between the oppositely disposed metal reinforced concrete beams 20 disposed on the top of oppositely disposed walls 36. In a single story building, a roof structure is directly disposed on top of the plurality of I-beams 23 while in a multi-story building the roof structure above the second or top floor is essentially the same if not the same as the roofing structure for a single story building.

Figure 4:
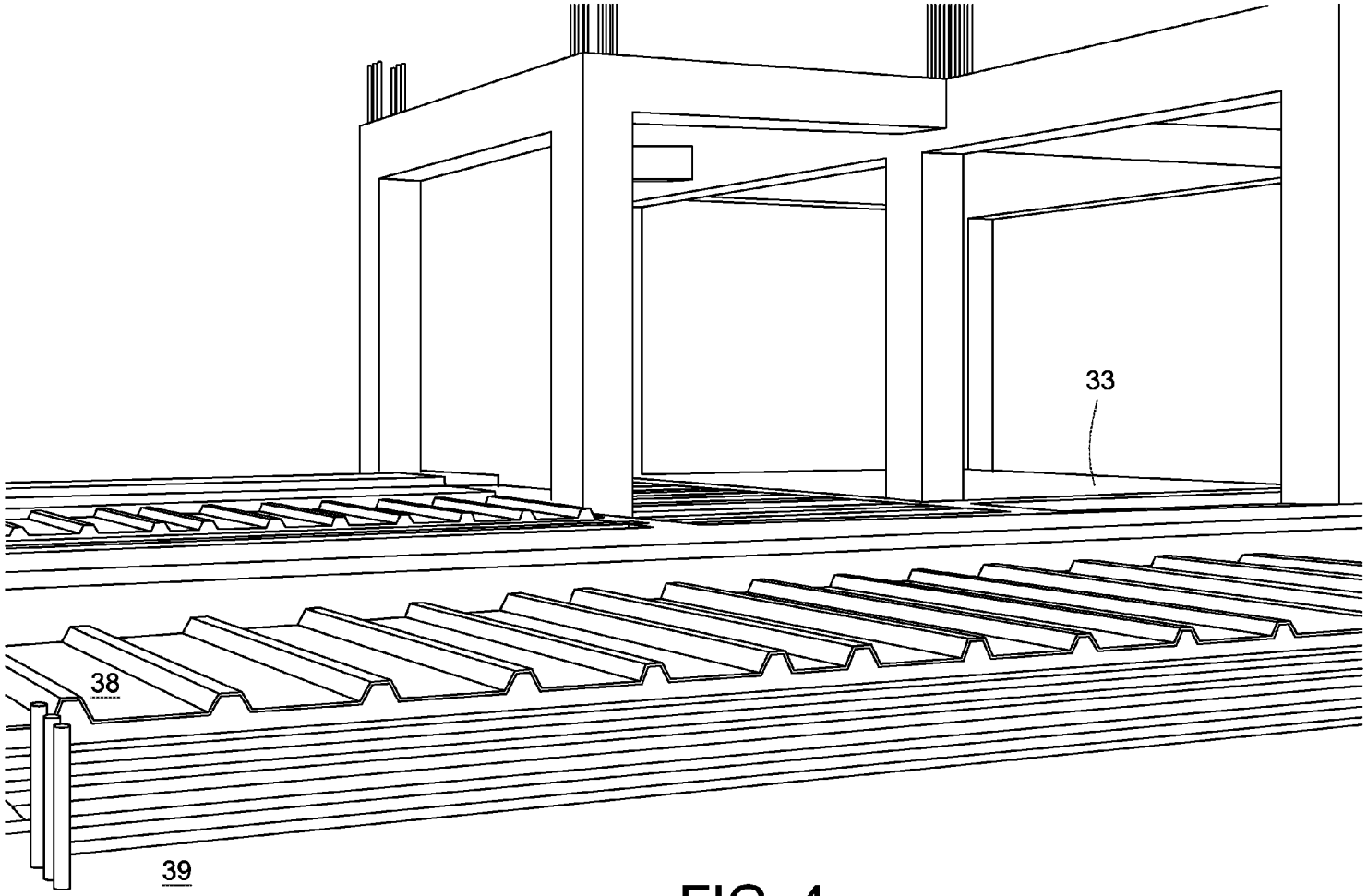
FIG. 4 is a sectional view of a building structure in accordance with one embodiment of the invention.
Figure 7:
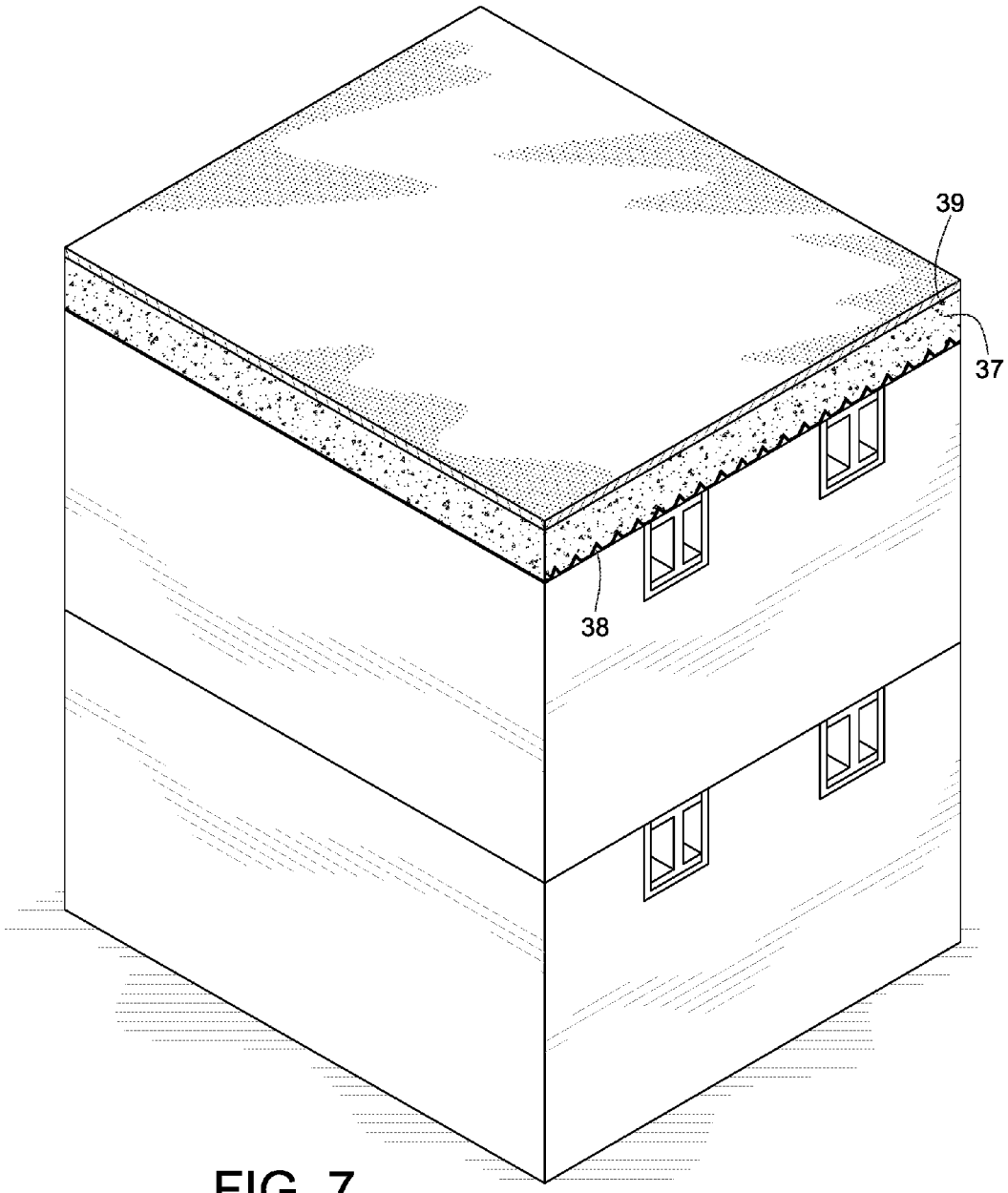
FIG. 7 is schematic illustration of a two story building according to the invention.

The roof structure includes a steel sheet or a plurality of steel sheets 38 (FIG. 4) and preferably a corrugated or corrugated steel sheets 38 (FIG. 4) laid directly on the top of the plurality of parallel I-beams 23. On top of the sheets 38 (FIG. 4) is a layer 37 of porous concrete of about 2 to about 4 inches thickness then a second layer 39 (FIG. 7) of waterproofing material such as tar or the like is placed on top of the porous concrete to avoid any leakage in the building. This roof structure may be tilted slightly in order for the rain to run off of the building.

In a single story building 10 in accordance with the present invention a conventional wood or tile floor 13 is disposed on a concrete slab 36 that is disposed on or adjacent to the foundation 32. A plurality of upwardly extending concrete columns 34 are disposed with one column disposed at each of the corners of the building. The columns 34 are connected by a plurality of concrete walls 15 that connect the columns 14 and form an outer surface surrounding the building 10. The walls 15 are connected with the columns 14.

In a preferred embodiment of the invention, a pair of metal reinforced concrete beams 20 are disposed on top of a pair of opposite walls with an open expanse that is covered by a sealing or roof made of or supported by a series of I-beams 23. Each I-beam includes an upper and lower metal flange of about equal width and a centrally disposed metal web connecting the upper and lower flanges. In the preferred embodiment of the invention, the I-beams are made of steel. The I-beam receptacles are spaced apart by between the width of an upper or lower flange and three times the width of one of the flanges. The length of the beam is preferably between about 8 feet and about 30 feet in length.

While the invention has been described in connection with its preferred embodiments, it should be recognized and understood that changes and modifications may be made therein without departing from the scope of the appended claims.

What is claimed is:

1. A metal reinforced concrete building including a concrete foundation and a plurality of upwardly extending concrete columns and a plurality of concrete walls including two opposite walls extending between and connecting said upwardly extending columns, and a pair of metal reinforced concrete beams with one of said pair of beams disposed on said two opposite walls and wherein each of I-beam receptacles in each of said beams are spaced apart along a length of said beams and wherein each of said I-beam receptacles has a width and a depth to accommodate an I-beam having an upper and lower metal flange of about equal width and a central metal web connecting said flanges and a hard elastomer of about ½ and one inch thickness between said I-beam and an I-beam receptacle and wherein said I-beam receptacles are spaced apart by a distance between the width of said upper or lower flange and up to three times the width of said upper or lower flange; and a plurality of I-beams extending across a space in said building between said opposite walls and positioned by and supported by said metal reinforced concrete beams.

2. The metal reinforced concrete building according to claim 1, in which each of said pair of metal reinforced concrete beams include one or more steel rebars extending along their length beneath said metal reinforced concrete beam.

3. A metal reinforced concrete building comprising a concrete foundation, a concrete floor, a plurality of upwardly extending concrete columns with one of said columns at each corner of said building and a plurality of concrete walls with two oppositely disposed walls on opposite sides of an open area in said building, and a pair of longitudinally extending metal reinforced concrete beams further consisting of a plurality of I-beam receptacles spaced apart along a length of said beams and wherein each of said I-beam receptacles in each of said beams has a width and a depth to accommodate an I-beam having an upper and a lower metal flange of about equal width and a central metal web connecting said flanges and a hard elastomer of about ½ and one inch thickness between said I-beam and said I-beam receptacles and wherein said I-beam receptacles are spaced apart by a distance between about the width of said upper flange and three times the width of said upper flange; and a plurality of I-beams each of which are disposed in said I-beam receptacles on opposite sides of said open areas in said building and a roof structure on top of said building.

4. A single story metal reinforced concrete building comprising:

a concrete foundation, a concrete slab disposed on and between said concrete foundation and a plurality of upwardly extending metal reinforced concrete columns with one of said columns in each of said four corners of said building and a plurality of concrete walls connecting said upwardly extending columns and with two spaced apart walls on opposite sides of an open area in said building;

a pair of longitudinally extending metal reinforced concrete beams including a plurality of I-beam receptacles spaced apart along a length of said beams and wherein each of said I-beam receptacles has a width and a depth to accommodate an I-beam and wherein said I-beam has an upper and a lower metal flange of about equal width and a central metal web connecting said flanges and a hard elastomer of about ½ inch and one inch between said I-beam and said I-beam receptacles and wherein said I-beam receptacles are spaced apart by a distance between about the width of said upper flange and three times the width of said upper flange; and a plurality of I-beams each of which is disposed between said walls on opposite sides of said building with one end thereof positioned within one of said I-beam receptacles and the opposite end within said I-beam receptacle in a second of said metal reinforced concrete I-beams, a corrugated steel sheet disposed in said I-beam and a layer of porous concrete on top of said corrugated sheet plus a waterproof layer having a thickness of about 1-2 inches.

* * * * *